US007025578B2

(12) United States Patent
Gardner

(10) Patent No.: US 7,025,578 B2
(45) Date of Patent: Apr. 11, 2006

(54) PUMP HAVING AIR VALVE WITH INTEGRAL PILOT

(75) Inventor: Richard Gardner, Montpelier, OH (US)

(73) Assignee: Ingersoll-Rand Company, Woodcliff, NJ (US)

( * ) Notice: Subject to any disclaimer, the term of this patent is extended or adjusted under 35 U.S.C. 154(b) by 361 days.

(21) Appl. No.: 10/431,279

(22) Filed: May 7, 2003

(65) Prior Publication Data

US 2004/0223860 A1 Nov. 11, 2004

(51) Int. Cl.
*F01L 15/18* (2006.01)
*F04B 17/00* (2006.01)

(52) U.S. Cl. ..... 417/395; 91/329

(58) Field of Classification Search ..... 417/392, 417/393, 395; 91/329
See application file for complete search history.

(56) References Cited

U.S. PATENT DOCUMENTS 514,608 A * 2/1894 Weatherhead ..... 417/393
1,155,282 A * 9/1915 Shaner ..... 173/127
3,548,716 A 12/1970 Rayl
3,652,187 A 3/1972 Loeffler et al.
4,008,984 A * 2/1977 Scholle ..... 417/393
4,019,838 A 4/1977 Fluck
4,494,912 A * 1/1985 Pauliukonis ..... 417/347
4,549,467 A 10/1985 Wilden et al.
4,682,937 A * 7/1987 Credle, Jr. ..... 417/393
5,232,352 A 8/1993 Robinson
5,391,060 A 2/1995 Kozumplik, Jr. et al.
5,567,118 A 10/1996 Grgurich et al.
6,382,934 B1 5/2002 Budde

* cited by examiner

*Primary Examiner*—Charles G. Freay
(74) *Attorney, Agent, or Firm*—Michael Best & Friedrich LLP

(57) ABSTRACT

A pump comprising a valve housing and a spool slidably positioned within the valve housing. The spool has a supply face, a first end face, and a second end face, and is slidable between a first position wherein pressurized supply air is supplied to the supply face and the first end face, the first end face having a greater surface area than the supply face, a second position wherein the supply air is supplied to the supply face and is blocked from both the first and second end faces, and a third position wherein the supply air is supplied to the supply face and the second end face.

14 Claims, 4 Drawing Sheets

PUMP HAVING AIR VALVE WITH INTEGRAL PILOT

BACKGROUND

The present invention relates to double-diaphragm pumps and particularly to valves that direct the flow of pressurized air to air chambers of double-diaphragm pumps. Conventional double-diaphragm pumps include two diaphragms, one coupled to each end of a connecting rod. Pressurized air is alternately pumped into and evacuated from air chambers created between each of the diaphragms and an air cap associated with each diaphragm. As pressurized air is being pumped into the air chamber associated with one diaphragm, the air chamber associated with the other diaphragm is evacuated so that the diaphragms work together in a reciprocating motion to pump a fluid through the pump.

In conventional double-diaphragm pumps, a main valve (typically a spool valve) controls the filling and emptying of the air chambers. The spool valve typically moves back and forth along its axis, connecting and blocking various channels through the pump to control the flow of pressurized air. Typically, a pilot valve associated with the main valve is used to start the main valve moving in one direction or another. The pilot valve is used to help "kick" the main valve back and forth.

SUMMARY OF THE INVENTION

According to the present invention, a pump includes a spool valve that acts as its own pilot valve.

DETAILED DESCRIPTION

Figure 1:
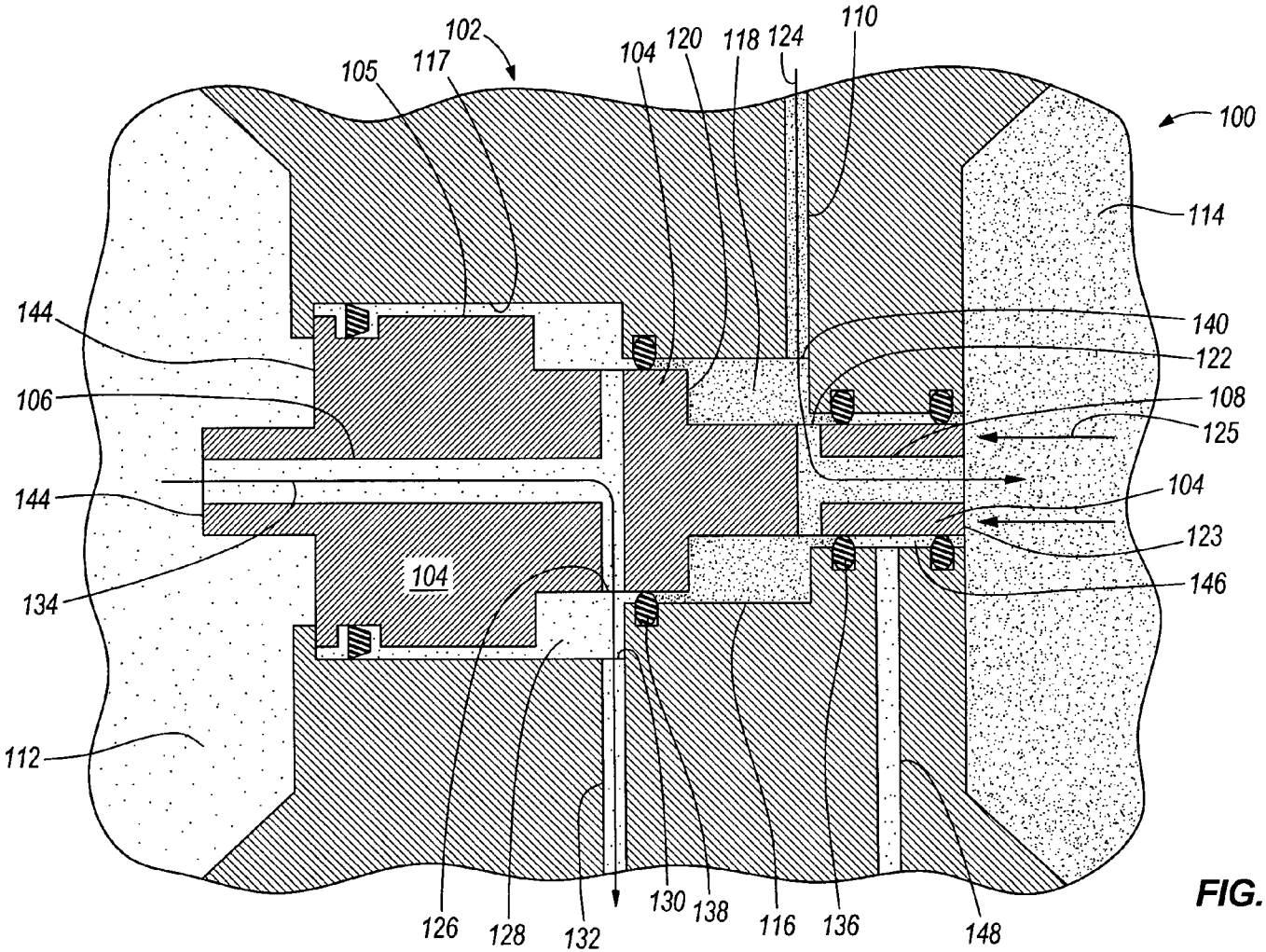
FIG. 1 is a schematic view of a pump according to the present invention including a spool valve having a spool positioned in a left-most position, thereby routing pressurized supply air to a right air chamber.

Referring to FIG. 1, a pump 100 according to the present invention includes a spool valve or main valve 102 having a spool 104. The spool 104 has an exterior surface 105 and includes a left channel 106 and a right channel 108 formed through the spool 104. As the spool 104 slides within a valve housing 116, the channels 106 and 108 alternatingly direct supply air from a supply channel 110 to either of a left air chamber 112 or right air chamber 114. The spool 104 is housed within the valve housing 116 so that the exterior surface 105 of the spool is spaced from an interior surface 117 of the housing 116. The left air chamber 112 and the right air chamber 114 are associated with left and right diaphragms, respectively, (not shown) in a double-diaphragm pump arrangement, as will be readily known to those of ordinary skill in the art. As will also be readily known to those of ordinary skill in the art, the supply of air to one of the left and right air chambers 112, 114 causes the diaphragm associated with that air chamber to move to an extended or outward position pumping fluid out of an associated fluid chamber (not shown) on the opposite side of the diaphragm. At the same time, the opposite diaphragm moves to a withdrawn or inward position, drawing fluid into a fluid chamber (not shown) associated with it.

Referring to FIG. 1, the spool 104 is moved to a left-most position within the valve housing 116. The spool 104 is moved to the left-most position as the result of supply air from the supply channel 110 filling a supply chamber 118, thereby applying force to a supply face 120. As can be seen with reference to FIGS. 1–3, and as will become more apparent below, the volume of the supply chamber 118 changes depending on the position of the spool 104. However, in all cases, the supply chamber 118 is being supplied pressurized air from the supply channel 110 and, therefore, the supply face 120 always has a force on it which makes the spool 104 tend to move to the left.

With the spool 104 moved to its left-most position as shown in FIG. 1, a right spool port 122 of the spool 104 is in fluid communication with the supply chamber 118. This allows pressurized air to flow from the supply chamber 118 through the right spool port 122 and into the right channel 108. In this way, air flows along a pathway 124 expanding the right air chamber 114 and driving its associated diaphragm outward. Additionally, the pressurized air flowing into the right air chamber 114 provides a force, indicated by arrows 125, on a right end face 123 that, along with the force on the supply face 120, pushes the spool 104 to the left. (It should be noted that in FIG. 1, as well as FIGS. 2 and 3, the pressurized supply air is indicated by a dark dotted texture. Although it is pointed out above that the supply air flows along pathway 124 when the spool 104 is in its left-most position, the dark dotted texture indicates the spaces that are filled with pressurized supply air. Additionally, exhaust air (discussed below) is indicated by a lighter dotted texture in FIGS. 1–3.)

Figure 4:
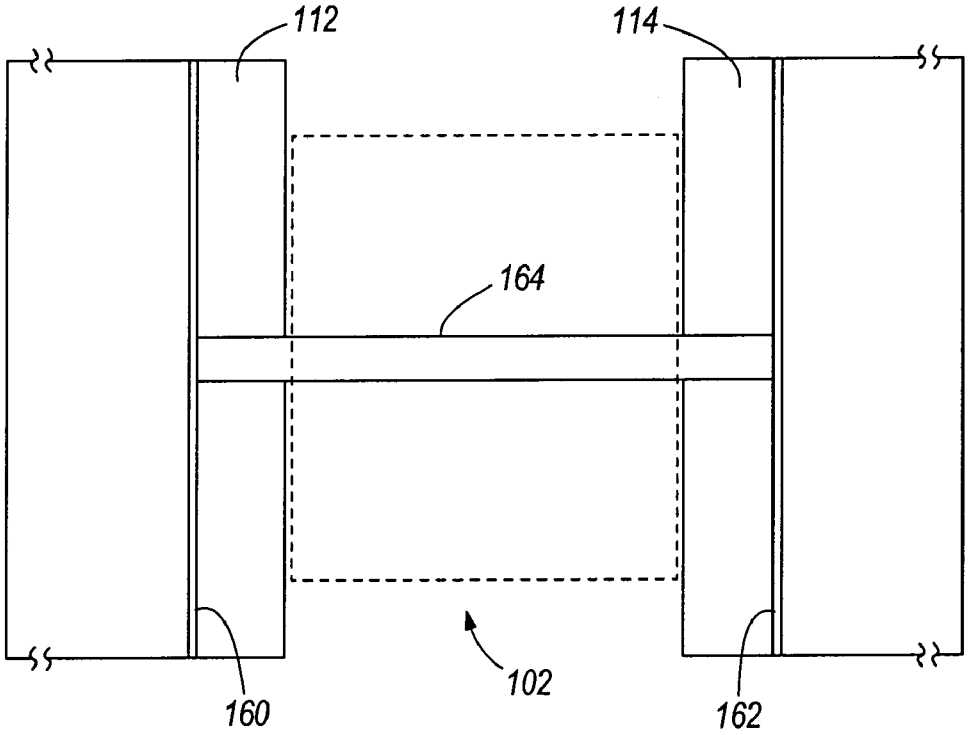
FIG. 4 is a schematic illustration of the pump of FIG. 1 according to an alternative embodiment of the present invention.

At the same time, with the spool 104 in its left-most position, a left spool port 126 is in fluid communication with a left exhaust chamber 128 that is connected through a left exhaust port 130 to a left exhaust channel 132. In this way, air is exhausted from the left air chamber 112 along a pathway 134 causing a left diaphragm associated with the left air chamber 112 to collapse inwardly. Additionally, as will be readily apparent to one of ordinary skill in the art, FIG. 4 illustrates an embodiment of the present invention wherein the right diaphragm 162 and left diaphragm 160 may be interconnected by a connecting rod 164. Therefore, the supply of pressurized air to the right air chamber 114 causing it to expand and drive its associated right diaphragm 162 outwardly will, through the connecting rod 164, pull the left diaphragm 160 inwardly.

Figure 2:
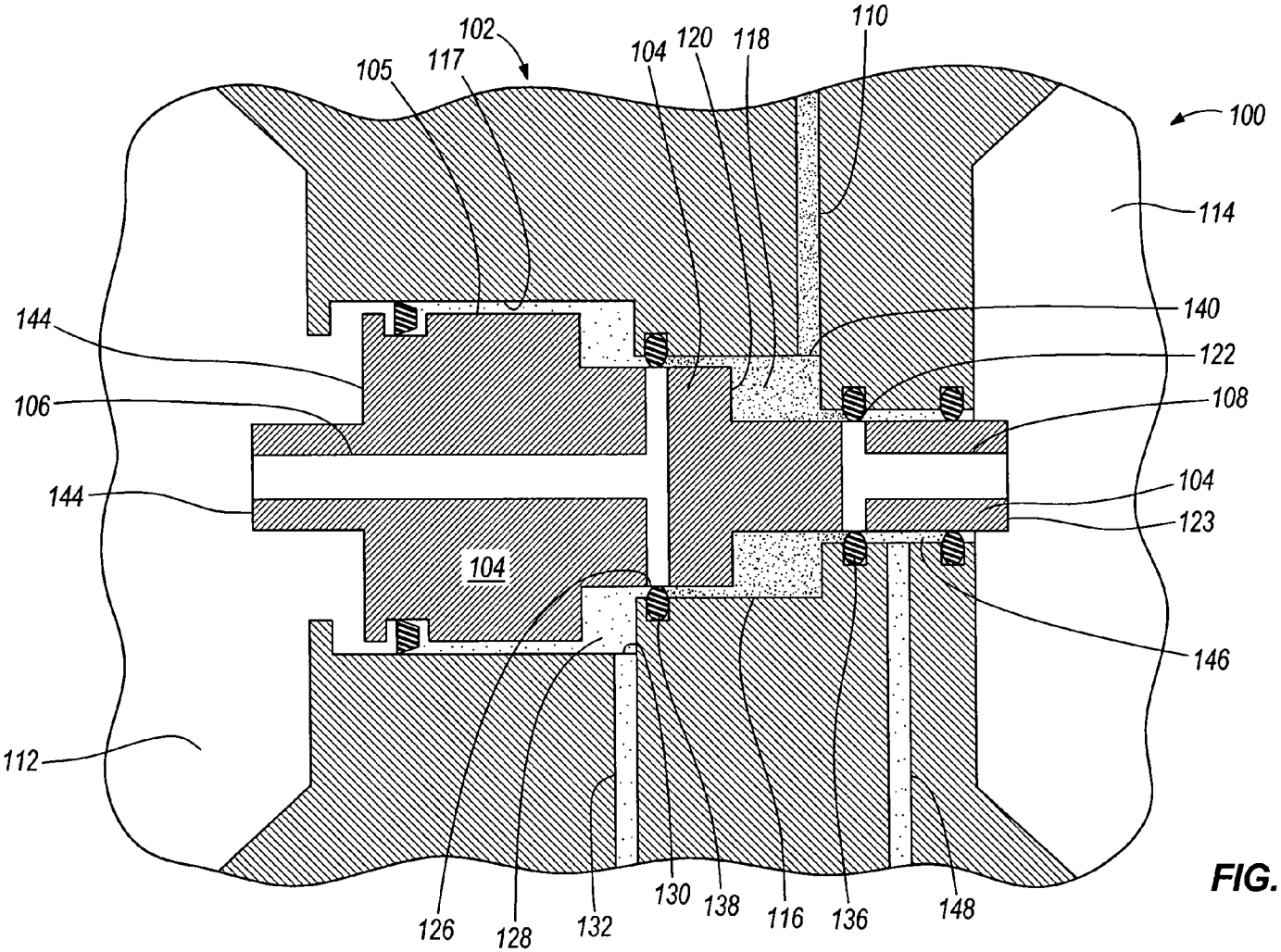
FIG. 2 is a schematic illustration of the pump of FIG. 1 with the spool in a center or intermediate position blocking the supply of pressurized air to the right air chamber and to a left air chamber.

When the left diaphragm moves to a certain extent inwardly, it begins pushing on the spool 104. The left diaphragm may push on the spool 104 through direct contact, or through some mechanical connection such as a pin, arm, tab, etc., as will be readily apparent to one of ordinary skill in the art. Eventually, the left diaphragm will move the spool 104 to an intermediate or center position, as shown in FIG. 2. Referring to FIG. 2, in the intermediate position, the right spool port 122 is blocked by a right seal 136, thereby cutting off the flow of pressurized supply air from the supply chamber 118 to the right air chamber 114. At the same time, a left seal 138 blocks the left spool port 126 so that it is no longer connected to the left exhaust chamber 128 and air is no longer exhausted from the left air chamber 112. With the spool 104 in its intermediate position, air is neither supplied to nor exhausted from either the left air chamber 112 or the right air chamber 114. However, the movement of the left diaphragm, discussed above, which moved the spool 104 to the intermediate position shown in FIG. 2, is sufficient to move the left spool port 126 just beyond the left seal 138, so that the left spool port 126 is in fluid communication with the supply chamber 118.

Figure 3:
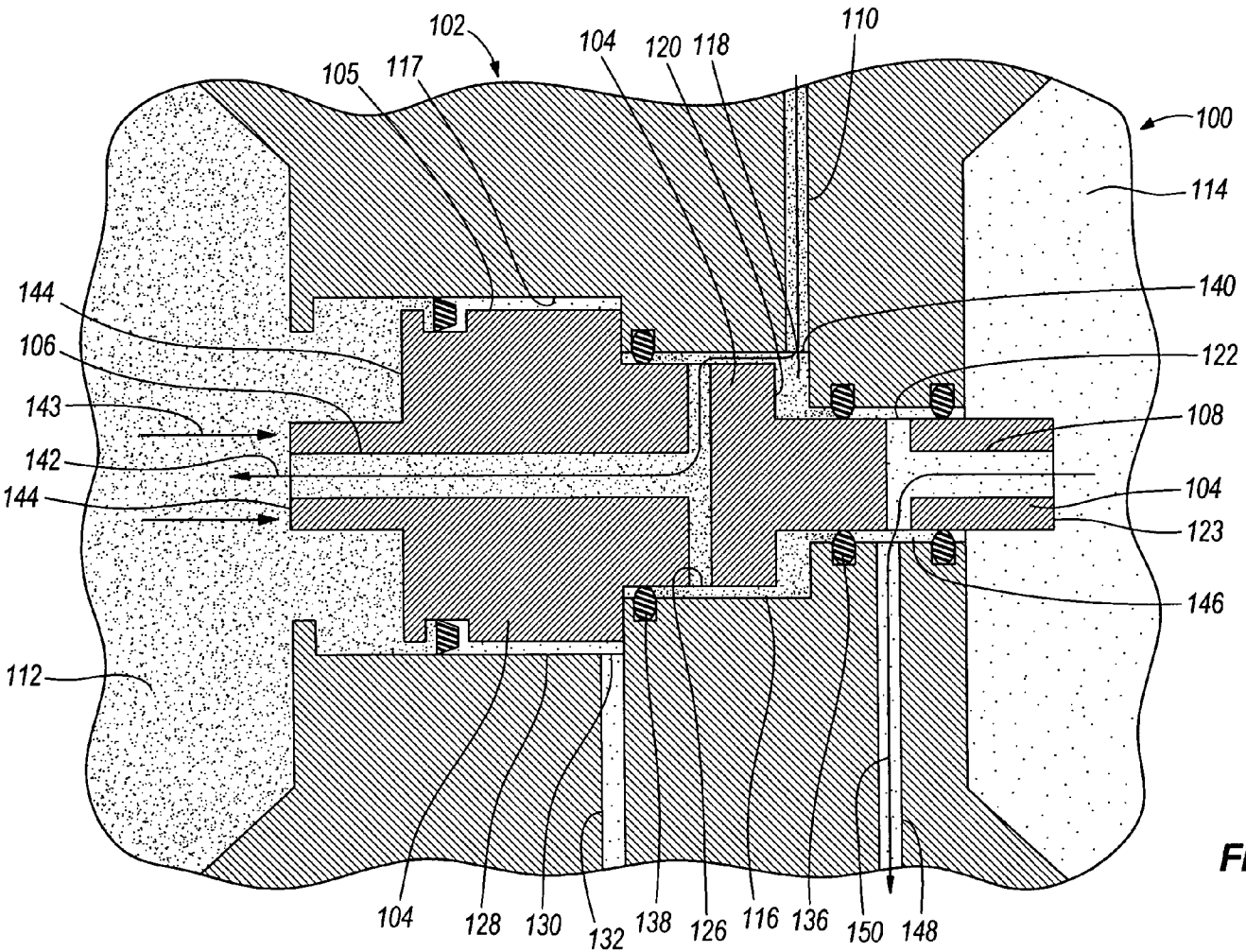
FIG. 3 is a schematic illustration of the pump of FIG. 1 with the spool in a right-most position, thereby routing pressurized supply air to the left air chamber.

Referring to FIG. 3, with the left spool port 126 in fluid communication with the supply chamber 118, pressurized supply air from the supply channel 110 flows through a supply port 140 along a pathway 142 and into the left air chamber 112. The flow of supply air into the left air chamber 112 creates a force, indicated by arrows 143, on a left-end face 144 of the spool 104. Even though the supply air continues to provide a force on the supply face 120 that tends to move the spool 104 to the left as discussed above, the spool 104 nevertheless moves to the right because the force 143 applied to the left-end face 144 is greater than the force on the supply face 120. This is because the total surface area of the surfaces that comprise the left-end face 144 is greater than the total surface area of the supply face 120. As shown in FIG. 3, the surface area of the left-end face 144 is approximately twice the surface area of the supply face 120. However, other configurations where the surface area of the left-end face 144 is greater than the surface area of the supply face 120 may be used. Because of the differential in surface areas between the left-end face 144 and the supply face 120, the spool 104 moves from a position wherein the left spool port 126 is just right of the left seal 138 to its right-most position.

With the spool 104 positioned as shown in FIG. 3, pressurized supply air is supplied to the left air chamber 112 pushing outwardly the left diaphragm. At the same time, the right spool port 122 is in fluid communication with a right exhaust chamber 146 that is connected to a right exhaust channel 148. In this way, air from the right air chamber 114 flows along a pathway 150 exhausting the right air chamber 114. In a manner similar to that discussed above with regard to the left diaphragm, this causes the right diaphragm to collapse inwardly. Eventually, the right diaphragm contacts, either directly or indirectly, the right end of the spool 104 urging it to the left. The collapsing movement of the right diaphragm causes the spool 104 to move left and again assume the intermediate position shown in FIG. 2. In the position shown in FIG. 2, the supply of pressurized air through the left spool port 126 and the left channel 106 is cut off, thus removing the force on the left-end face 144. The force on the supply face 120 created by the pressurized air in the supply chamber 118 takes over in the absence of the force 143 on the left-end face 144. Therefore, the spool 104 tends to again move to the left once the collapsing right diaphragm has moved the spool 104 far enough over (to its trip point) so that the left seal 138 cuts off the flow of supply air through the left spool port 126. The force of the pressurized supply air on the supply face 120 moves the spool 104 to its left-most position as shown in FIG. 1, and the cycle discussed above starts over.

Although the invention has been described in detail with reference to certain described constructions, variations and modifications exist within the scope and spirit of the invention as described and defined in the following claims.

The invention claimed is:

1. A pump comprising:

a spool slidably positioned within a housing, the spool having an exterior surface and the housing having an interior surface, the exterior surface of the spool having a first spool port in fluid communication with a first diaphragm chamber and a second spool port in fluid communication with a second diaphragm chamber, the interior surface of the housing having a supply inlet port, a first exhaust port and a second exhaust port, and wherein the spool is slidable between a first position wherein the supply inlet port is in fluid communication with the first spool port and the second spool port is in fluid communication with the second exhaust port and a second position wherein the supply inlet port is in fluid communication with the second spool port and the first spool port is in fluid communication with the first exhaust port; and wherein with the spool in both the first and second positions, the supply inlet port is in fluid communication with a supply face of the spool, the supply face being substantially perpendicular to an axis of motion along which the spool slides and having a surface area less than a surface area of a first end face of the spool that is substantially parallel to the supply face.

2. The pump of claim 1, wherein the surface area of the first end face of the spool is at least twice the surface area of the supply face of the spool.

3. The pump of claim 1, wherein the first end face comprises multiple surfaces and the surface area of the first end face is the total surface area of the multiple surfaces.

4. The pump of claim 1, wherein the spool further includes a second end face that has a surface area less than the surface area of the supply face, the supply face being between the first and second end faces.

5. A pump comprising:

a first diaphragm chamber;

a second diaphragm chamber;

a stepped spool positioned between the first and second diaphragm chamber and having first, second, and third portions, the first portion having a greater diameter than the second portion and the second portion having a greater diameter than the third portion, the first, second, and third portions each having an exterior surface spaced apart from an interior surface of a housing within which the spool is slidably positioned;

a first seal positioned between the exterior surface of the first portion and the interior surface of the housing;

a second seal positioned between the exterior surface of the second portion and the interior surface of the housing;

third and forth seals positioned between the exterior surface of the third portion and the interior surface of the housing;

a supply chamber defined between the second seal and the third seal;

a first exhaust chamber defined between the first seal and the second seal;

a second exhaust chamber defined between the third seal and the fourth seal; and wherein the spool is moveable between a first position wherein a first channel through the spool fluidly connects the supply chamber and the first diaphragm chamber and a second channel through the spool fluidly connects the second exhaust chamber and the second diaphragm chamber, and a second position wherein the second channel fluidly connects the supply chamber and the second diaphragm chamber and the first channel fluidly connects the first exhaust chamber and the first diaphragm chamber.

6. The pump of claim 5, wherein the spool further includes a first end face, a second end face, and a supply face, the first channel extending through the first end face and the second channel extending through the second end face, and wherein the supply face is positioned between the first channel and the second channel, the supply face having a greater surface area than the second end face and a lesser surface area than the first end face.

7. The pump of claim 6, wherein the supply face is positioned between the first end face and the second end face and the supply face, first end face, and second end face are all substantially parallel.

8. The pump of claim 5, wherein the spool further includes a first end face, a second end face, and a supply face, the supply face being positioned in the supply chamber in both the first and second positions of the spool, and the first end face, second end face, and supply face are all substantially parallel.

9. A method of driving a double diaphragm pump having a spool valve, the method comprising:

supplying pressurized supply air to a supply face of a spool of the spool valve to move the spool in a first direction;

routing the supply air through a second end of the spool that is in fluid communication with a second diaphragm chamber housing a second diaphragm, the second end of the spool being away from the first direction;

routing exhaust air from a first diaphragm chamber housing a first diaphragm through a first end of the spool to an exhaust chamber, the first end of the spool being toward the first direction;

translating movement of the first diaphragm to the spool to move the spool in a second direction that is opposite the first direction;

blocking the supply of supply air through the second end of the spool;

routing the supply air through the first end of the spool to supply air to the first diaphragm chamber and to an end face that is at the first end of the spool, the force of the supply air on the end face being greater than the force of the supply air on the supply face; and routing exhaust air from the second diaphragm chamber, through the second end of the spool, to the exhaust chamber.

10. The method of claim 9, further comprising translating movement of the second diaphragm to the spool to move the spool in the first direction to a trip point where the supply of supply air to the first diaphragm chamber is blocked.

11. A pump comprising:

a valve housing; and a spool slidably positioned within the valve housing and having a supply face, a first end face, and a second end face, and wherein the spool is slidable between a first position wherein pressurized supply air is supplied to the supply face and the first end face, the first end face having a greater surface area than the supply face, a second position wherein the supply air is supplied to the supply face and is blocked from both the first and second end faces, and a third position wherein the supply air is supplied to the supply face and the second end face.

12. The pump of claim 11, wherein the surface area of the second end face is less than the surface area of the supply face.

13. The pump of claim 12, wherein the surface area of the supply face is less than one half the surface area of the first end face.

14. The pump of claim 11, wherein the surface area of the supply face is less than one half the surface area of the first end face.

* * * * *